US008677868B2

(12) United States Patent
Hoffman et al.

(10) Patent No.: US 8,677,868 B2
(45) Date of Patent: Mar. 25, 2014

(54) DETENTED ADAPTER INTERFACE FOR SCREWDRIVER TOOL ATTACHMENT

(75) Inventors: William H. Hoffman, Cincinnati, OH (US); Michael R. Desmond, Cold Spring, KY (US)

(73) Assignee: Senco Brands, Inc., Cincinnati, OH (US)

( * ) Notice: Subject to any disclaimer, the term of this patent is extended or adjusted under 35 U.S.C. 154(b) by 731 days.

(21) Appl. No.: 12/898,243

(22) Filed: Oct. 5, 2010

(65) Prior Publication Data

US 2012/0073410 A1 Mar. 29, 2012

Related U.S. Application Data

(60) Provisional application No. 61/387,701, filed on Sep. 29, 2010.

(51) Int. Cl.
*B25B 23/04* (2006.01)
*B25B 23/06* (2006.01)

(52) U.S. Cl.
USPC ..... 81/434; 81/57.3; 409/182; 279/150; 279/145

(58) Field of Classification Search
USPC ..... 81/57.37, 430–435; 173/1; 279/145
See application file for complete search history.

(56) References Cited

U.S. PATENT DOCUMENTS 3,891,014 A * 6/1975 Gunn ..... 81/57.37
4,428,261 A * 1/1984 Takatsu et al. ..... 81/434
5,101,697 A * 4/1992 Fishback ..... 81/434
5,443,340 A 8/1995 Reinauer et al. ..... 409/233
5,473,965 A * 12/1995 Chen ..... 81/434
5,988,026 A 11/1999 Reckelhoff et al. ..... 81/434
6,056,298 A * 5/2000 Williams ..... 279/150
6,139,228 A 10/2000 Longo ..... 408/240
6,647,836 B1 * 11/2003 Habermehl ..... 81/434
6,769,332 B2 * 8/2004 Muro ..... 81/434
6,786,685 B2 9/2004 Schaub et al. ..... 408/240
7,032,482 B1 4/2006 Hoffman ..... 81/434
7,082,857 B1 8/2006 Hoffman ..... 81/57.16
7,237,457 B2 * 7/2007 Hsu ..... 81/57.3
7,293,944 B2 * 11/2007 Lui ..... 409/182
7,493,839 B2 2/2009 Massari, Jr. et al. ..... 81/434
7,537,421 B2 5/2009 Puzio et al. ..... 408/124
2013/0112050 A1 * 5/2013 Hoffman ..... 81/434

* cited by examiner

*Primary Examiner* — Lee D Wilson
*Assistant Examiner* — Melanie Alexander
(74) *Attorney, Agent, or Firm* — Frederick H. Gribbell

(57) ABSTRACT

An attachment is mated to a power screwdriver by use of an adapter that is first fixed onto the screwdriver. The attachment includes an automatic fastener driver that receives a collated strip of fasteners, and drives them into a working surface. The attachment is mated to the adapter; the attachment contains a radial type of mechanical coupling that can be rotated without dismounting the attachment from the power screwdriver. In this manner, the angular orientation between the attachment and the power screwdriver can be changed "on the fly" by the user. This combination allows the user to keep his or her hands at their operating positions throughout this procedure, thereby allowing the user to re-commence using the combination tool quickly after readjusting the operating angle.

16 Claims, 12 Drawing Sheets

DETENTED ADAPTER INTERFACE FOR SCREWDRIVER TOOL ATTACHMENT

CROSS-REFERENCE TO RELATED APPLICATIONS

The present application claims priority to provisional patent application Ser. No. 61/387,701, titled "DETENTED ADAPTER INTERFACE FOR SCREWDRIVER TOOL ATTACHMENT," filed on Sep. 29, 2010.

TECHNICAL FIELD

The technology disclosed herein relates generally to automatic screwdriving tools, particularly ones that receive a collated strip of screws to be driven into a surface, and is particularly directed to a combination tool of the type which mounts an attachment to the front end of a power screwdriver. A "regular" power screwdriver cannot be used with the collated strip; its normal use is with a single screw, manually fed. Therefore, the attachment mounts to the power screwdriver, and the attachment allows the overall tool to be used with a collated strip that holds multiple individual screws, and thereby allows this tool combination to be used as an automatic screwdriver.

Embodiments are specifically disclosed as an "adapter" that is first attached to the front end of the power screwdriver. The interior portion of the adapter is shaped to mate with a specific brand and model of power screwdriver. The attachment is then mounted to the front of the adapter. This attachment contains a rotatable type of mechanical coupling that can be rotated without dismounting the attachment from the power screwdriver. In this manner, the angular orientation between the attachment and the power screwdriver can be changed without dismounting the attachment from the power screwdriver, and then re-mounting the attachment thereto. This adapter/attachment combination allows the angular position to be altered, without dismounting the attachment, and also allows the user to keep his or her hands at their operating positions throughout this procedure, thereby allowing the user to re-commence using the combination tool quickly after readjusting the operating angle.

In this design, the attachment can be rotated to several discrete angular positions, referred to as "detent positions." These detent positions provide the user with a positive "feel" that the tool is again ready for use. A similar tool could be designed to allow the attachment to be rotated to any variable angular position, without detent positions, if desired.

STATEMENT REGARDING FEDERALLY SPONSORED RESEARCH OR DEVELOPMENT

None.

BACKGROUND

Automatic screwdriver tools are common, and one standard methodology for using automatic screwdriver tools is to provide a power screwdriver that works with only single screws at a time, mate that with a specialized attachment that additionally provides a collated strip of fasteners, and make that combination work together so that the power screwdriver can work as an automatic screwdriver tool that can quickly drive a series of fasteners from the collated strip. In general, the adapter is used as a method for creating a common interface geometry on a variety of electric screwdrivers from various brands. The internal design of the adapter matches the external design of the specific power screwdriver. The external design of the adapter looks the same and interfaces with the attachment product, in which the adapter and attachment are typically provided by the same vendor.

One problem with this arrangement is that the power screwdriver cannot simply mate to an attachment without some type of adapter. Such adapters are already common in the tool industry; such adapters typically are fixedly attached to the front end of the power screwdriver, and then the opposite end of the adapter is fitted into an interior region of the attachment that holds the collated strip of fasteners.

One of the problems with such conventional attachments with adapters is that the angular orientation between the attachment and the power screwdriver cannot be changed without dismounting the attachment from the power screwdriver. In the known conventional tools, the attachment can be rotated, but only if the attachment is completely dismounted from the adapter, and then re-mounted at a different angular position. This operation requires the user of the tool combination to move his or her hands from their normal operating positions to a specific area of the attachment so that latches can be actuated to dismount the attachment from the adapter (that is itself mounted on the front end of the power screwdriver). Once the attachment has been dismounted, then it can be re-mounted to the adapter/power screwdriver combination, at a different angle. Only then can the operator put his or her hands back to their normal operating positions, and then continue working with the tool.

SUMMARY

Accordingly, it is an advantage to provide an attachment for a power screwdriver tool and a mating adapter, in which the attachment and adapter combination can be oriented at different angular positions with respect to one another, without the attachment having to be dismounted from the adapter.

It is another advantage to provide an attachment/adapter combination for a power screwdriver in which the adapter includes several discreet angular detent positions that provide the user with a positive "feel" when rotating the attachment to a different angular orientation with respect to the adapter, in which the adapter is mounted to a power screwdriver.

It is yet another advantage to provide an attachment/adapter combination with a power screwdriver tool, in which the attachment includes a detent spring with an inward-protruding notch that fits into one of several notches that are used as detent positions, and in which the attachment can be rotated so that the inward protrusion can be forced out of the notch and twisted in an arcuate movement until the inward protruding notch reaches another groove to provide a different detent position, thereby allowing the tool to be angularly changed in orientation without the detachment being dismounted from the power screwdriver/adapter combination.

It is still another advantage to provide an attachment/adapter for use with a power screwdriver, in which the attachment includes a leaf spring with a spherical member that fits into a groove in the adapter, and in which the spherical member can be moved out of the groove by an angular twisting motion so that the attachment is moved in an arcuate rotation along the surface of the adapter until the spherical member reaches another groove, thereby providing another detent position, so that the tool is again ready for use.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, a tool apparatus is provided, which comprises: (a) an attachment having: (i) a first end with an indexing mechanism to move a collated strip of fasteners so that the fasteners can be driven, and (ii) a second end with an open area having an interior mating surface; (b) an adapter having a third end with an exterior mating surface, and a fourth end that is shaped for mounting to a power screwdriver; (c) the exterior mating surface of the adapter is shaped to fit within the interior mating surface of the attachment; (d) the attachment includes at least one manually-actuated movable latch that, if not actuated, has a contact member that engages an area of the exterior mating surface of the adaptor to hold the attachment and the adapter in a substantially fixed axial relationship, wherein if the movable latch is actuated, the contact member becomes disengaged from the area of the exterior mating surface of the adapter, and thereby allows the attachment to be dismounted from the adapter; (e) the exterior mating surface including an area that comprises a plurality of sliding surfaces that are separated from one another by a plurality of grooves formed in the area; and (f) the interior mating surface including a detent spring that exhibits an inward-facing protrusion that, when the adapter is mated to the attachment, is in physical contact with at least one of: (i) the plurality of sliding surfaces and (ii) the plurality of grooves, such that: if the protrusion is substantially in contact with one of the plurality of grooves, then the attachment is in a detent position and will not readily move in a radial direction with respect to the adapter; and if the protrusion is substantially in contact with one of the plurality of sliding surfaces, then the attachment is in a condition that allows movement in the radial direction with respect to the adapter, while the attachment remains mounted to the adapter.

In accordance with another aspect, a tool apparatus is provided, which comprises: (a) an attachment having: (i) a first end with an indexing mechanism to move a collated strip of fasteners so that the fasteners can be driven, and (ii) a second end with an open area having an interior mating surface; (b) an adapter having a third end with an exterior mating surface, and a fourth end that is shaped for mounting to a power screwdriver; (c) the exterior mating surface of the adapter is shaped to fit within the interior mating surface of the attachment; (d) the attachment includes at least one manually-actuated movable latch that, if not actuated, has a contact member that engages an area of the exterior mating surface of the adaptor to hold the attachment and the adapter in a substantially fixed axial relationship, wherein if the movable latch is actuated, the contact member becomes disengaged from the area of the exterior mating surface of the adapter, and thereby allows the attachment to be dismounted from the adapter; (e) the exterior mating surface including an area that comprises a plurality of sliding surfaces that are separated from one another by a plurality of grooves formed in the area; and (f) the interior mating surface including a spherical member that is held in a predetermined angular position by an opening of a leaf spring, and when the adapter is mated to the attachment, the spherical member is in physical contact with at least one of: (i) the plurality of sliding surfaces and (ii) the plurality of grooves, such that: if the spherical member is substantially in contact with one of the plurality of grooves, then the attachment is in a detent position and will not readily move in a radial direction with respect to the adapter; and if the spherical member is substantially in contact with one of the plurality of sliding surfaces, then the attachment is in a condition that allows movement in the radial direction with respect to the adapter, while the attachment remains mounted to the adapter.

In accordance with yet another aspect, a method for operating a combination power tool is provided, in which the method comprises the following steps: (a) providing: (i) a power screwdriver; (ii) providing an adapter that is fixedly attached to the power screwdriver, the adapter having an exterior mating surface; and (iii) providing an attachment that is removably attachable to the adapter, the attachment having: (A) a distal end with an indexing mechanism to move a collated strip of fasteners so that the fasteners can be driven, and (B) a proximal end with an open area having an interior mating surface; (b) mounting the attachment to the power screwdriver, by inserting the exterior mating surface of the adapter into the interior mating surface open area of the attachment, wherein a contact member of at least one manually-actuated movable latch of the attachment is moved into a retaining groove that is included on the adapter, thereby holding the attachment and the adapter in a substantially fixed axial relationship; and (c) after the mounting step is completed, changing a radial angle orientation between the attachment and the power screwdriver without dismounting the attachment from the power screwdriver, by: (i) twisting the attachment with a first hand while holding the power screwdriver with a second hand, and (ii) causing a deflectable element of the attachment to move along at least one sliding surface of the adapter in a radial direction, from a first radial angular position to a second radial angular position, such that the deflectable element is able to move as necessary in a diametral direction, but at the same time is retained to the attachment.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
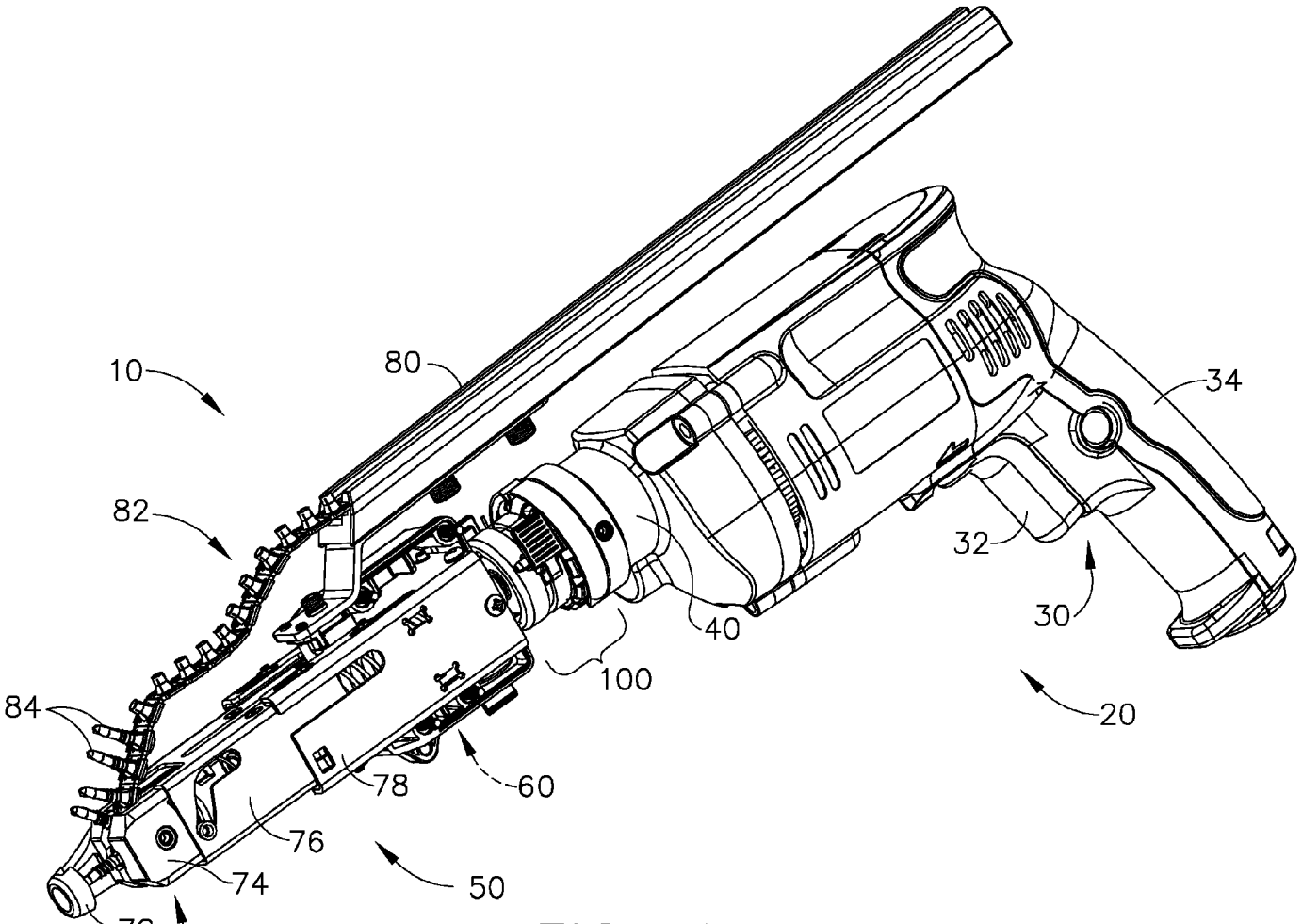
FIG. 1 is a perspective view from above, the front, and the left, of a combination tool that includes a power screwdriver, an adapter, and an attachment that feeds a collated strip of fasteners thereto.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIG. 1, a combination power tool is generally designated by the reference numeral 10, and includes a power screwdriver 20, an attachment 50 that makes the tool usable with a strip of collated fasteners (e.g., screws), and an adapter interface, which is generally designated by the reference numeral 100. The power screwdriver 20 can be one of many different models made by various manufacturers, and their common characteristic is that they have an output shaft that can drive a fastener, and they include an electric motor or pneumatic motor. Power screwdriver 20 includes a handle 34 which has a hand-operated trigger mechanism 32. The forward portion of the screwdriver is generally designated by the reference numeral 40, which connects to the interface 100. The area 30 designates a gripable area and if the user is right-handed, then the user's right hand would typically grip the handle 34 and actuate the trigger 32.

The attachment 50 in FIG. 1 includes a feed rail 80, which allows a strip of collated fasteners to pass therethrough, and in FIG. 1 this strip is designated by the reference numeral 82. The individual fasteners are designated at reference numeral 84 as they approach a nosepiece 72, at the forward-most portion of the attachment, generally designated by the reference numeral 70. (The forward-most portion of attachment 50 is also sometimes referred to herein as the "distal end," while the opposite end of attachment 50 is sometimes referred to herein as the "proximal end.") This particular view shows the attachment 50 without its housing support (which is illustrated on FIG. 2). In FIG. 1, the reference numeral 60 generally designates the area where the user's other hand will grip the combination tool/attachment, and this can be better seen in FIG. 2.

FIG. 1 shows more of the internal mechanism of the attachment 50, since the housing support has been removed from this view. Some of the mechanical components include a fastener indexing mechanism at 74 that receives a strip of collated fasteners (e.g., screws) 82 and indexes a single fastener to the "firing position," at the proper time. Reference numeral 76 shows a slideable "tube" which collapses into a fixed tube at 78. The rearward portion of the fixed rail or fixed tube 78 mechanically connects to the interface 100.

Figure 2:
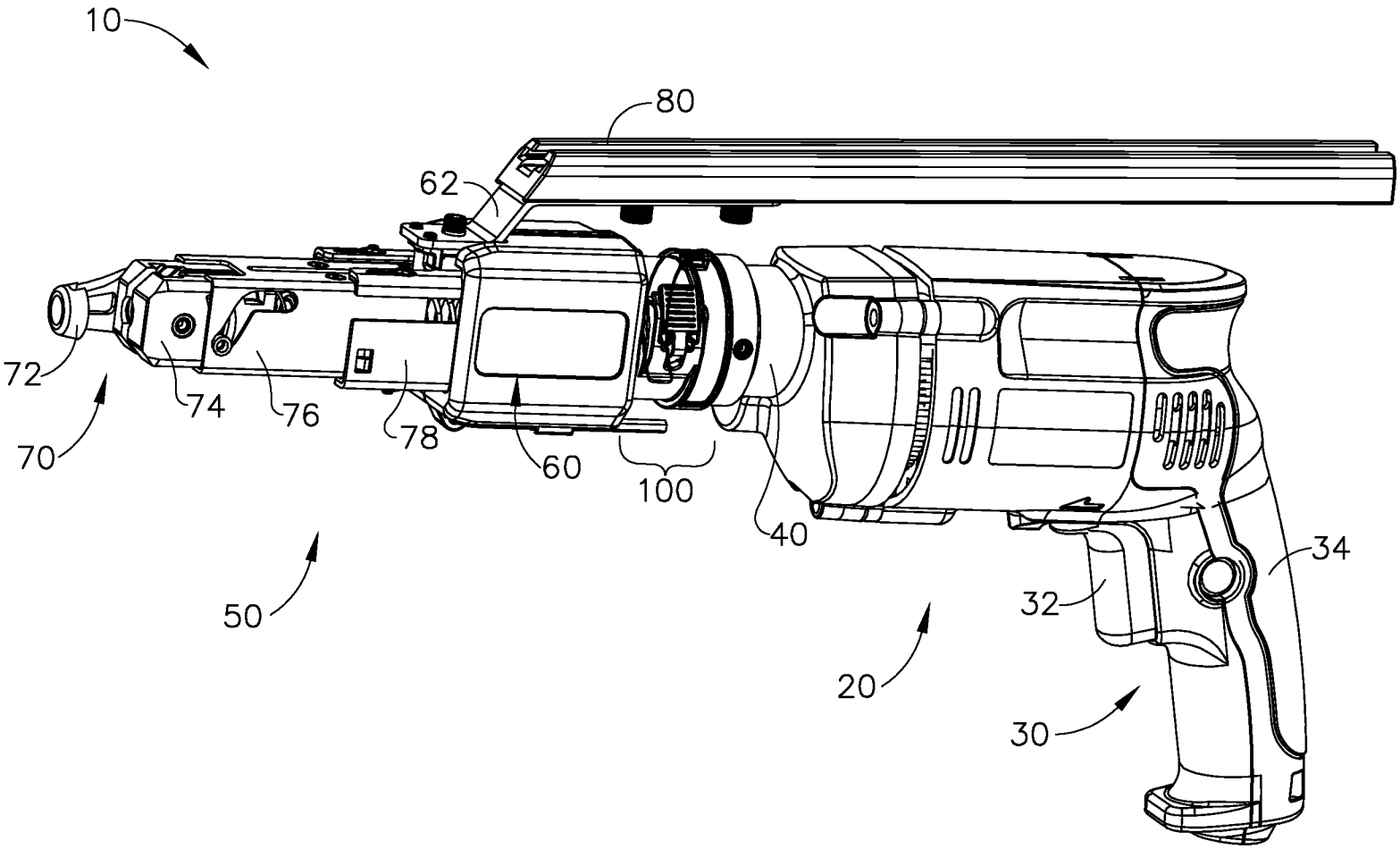
FIG. 2 is a perspective view of the combination tool of FIG. 1, again from the front, above, and the left side, this time showing the tool with its housing support.

Referring now to FIG. 2, the housing support is seen in this view and provides a gripable area 60, which is clearly illustrated on FIG. 2. The other components of FIG. 1 can also be seen on FIG. 2. This particular attachment mechanism 50 is similar to a TyRex brand attachment, model number TY0100. The guide rail 80 is attached to the upper portion of the attachment 50 by a mounting bracket 62.

Figure 3:
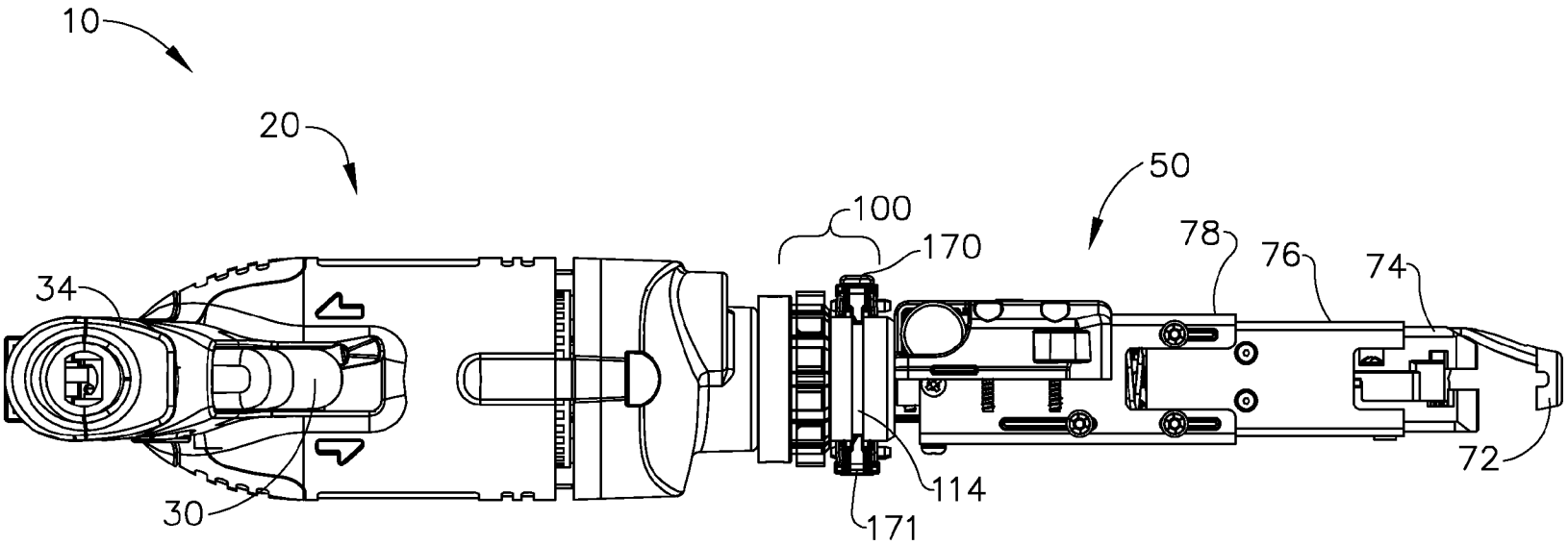
FIG. 3 is a bottom elevational view of the combination tool of FIG. 1.

Referring now to FIG. 3, the combination power screwdriver and attachment is again illustrated, and is designated by the reference numeral 10, this time in a bottom view. In this view a few additional mechanical elements can be seen in some detail in part of the interface portion 100. For example, there are two retaining latches 170 and 171, and their extended retaining portions extend into a groove 114 that is circular in shape. This retaining groove 114 is formed in the rear portion of the adapter. Additional details of these structures will be depicted in the other views, and described in greater detail below.

Referring now to FIG. 4, there are four separate views of an adapter interface, which is generally designated by the reference numeral 110. These views are referred to as FIG. 4A, FIG. 4B, FIG. 4C, and FIG. 4D. These four views show the adapter, which also is used as the interface between the screwdriver tool and the attachment. Adapter 110, as seen in FIG. 4C, has a left-most cylindrical outer surface 112, then an annular groove or notch 114, which leads to another cylindrical outer surface 116. The outer diameter then increases with a chamfer 126 to a larger outer diameter 122, and at the right-most portion of the adapter, the outer diameter again increases at 118. The outer diameter 118 is larger than the output end portion of the power screwdriver tool 20, and thus fits over the outside housing at that output end portion 40 of the tool. On the opposite end of the adapter, the cylindrical surface 112 fits inside the opening of the receiving end of the attachment 50.

As can be seen in many of the views of FIG. 4, the outer diameter formed at surfaces 122 has multiple longitudinal grooves 124 between multiple segmented surfaces 122. This series of grooves and segmented surfaces forms a virtual outer diameter ring that is generally designated by the reference numeral 120 on FIG. 4C. The segmented surfaces 122 work as "sliding surfaces," because they will allow a detent spring (not seen in this view) to slide across each of those surfaces 122 until the detent spring reaches one of the grooves 124. This is a main feature of this device, and will be discussed in greater detail below. A preferred material for adapter 110 is die-cast aluminum, although many other materials would be sufficient.

Figure 4A:
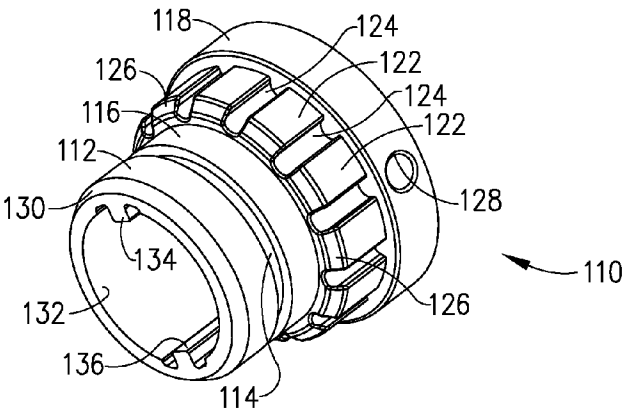
FIG. 4 is a drawing having four views, FIGS. 4A, 4B, 4C, and 4D, showing an adapter used in the combination tool of FIG. 1, in a perspective view, front view, side view, and rear view, respectively.
Figure 4D:
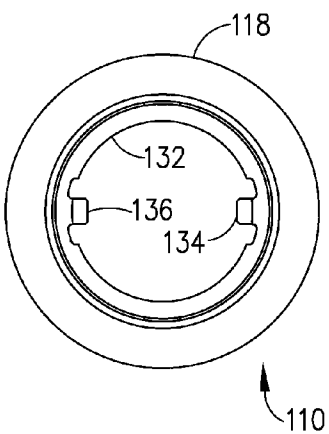

The largest outer diameter surface 118 includes at least one aperture at 128 as can be seen in FIG. 4A. This is used to mount the adapter 110 onto the power screwdriver 20. It will be understood that different types of power screwdrivers will have different ways of mounting an adapter thereto, including some type of threaded arrangement, rather than a screw or bolt that feeds through an aperture, such as the aperture 128 on FIG. 4. Another mounting alternative is to have slots that receive clamp screws to hold the adapter 110 onto the front end of the power screwdriver, as needed.

Figure 4C:
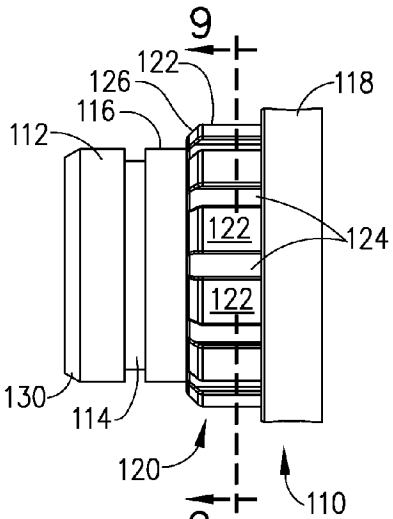
Figure 4B:
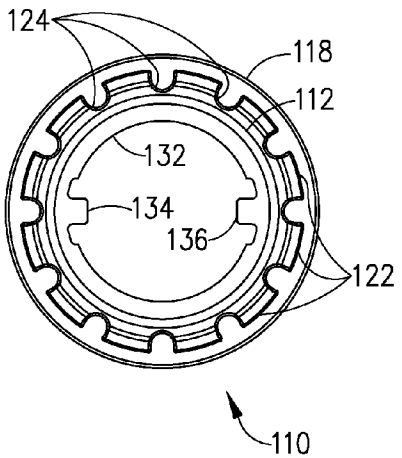
Figure 5C:
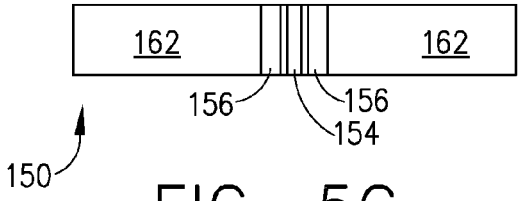
FIG. 5 has four views, FIGS. 5A, 5B, 5C, and 5D, showing a detent spring used in one embodiment of the combination tool of FIG. 1, showing a perspective view, front view, top view, and bottom view, respectively.
Figure 5A:
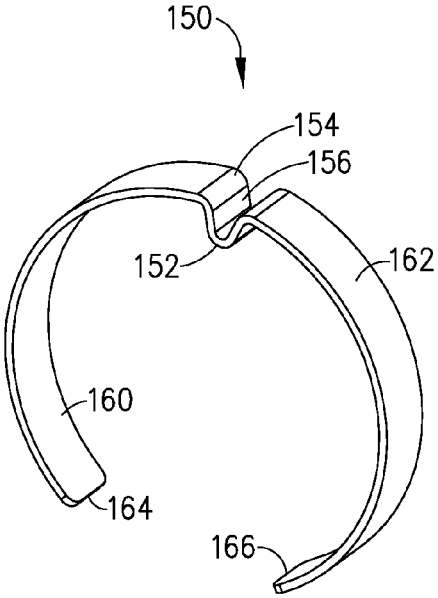
Figure 5B:
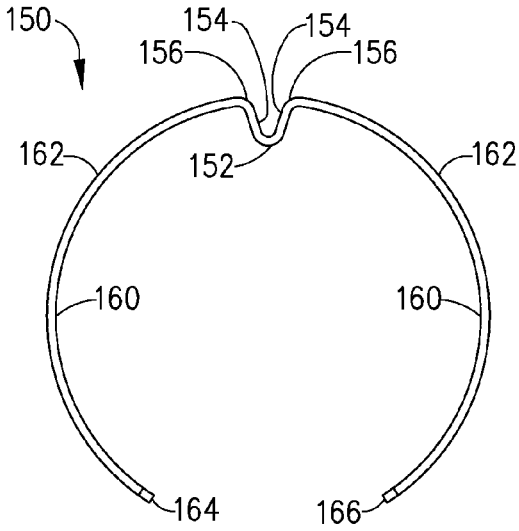
Figure 5D:
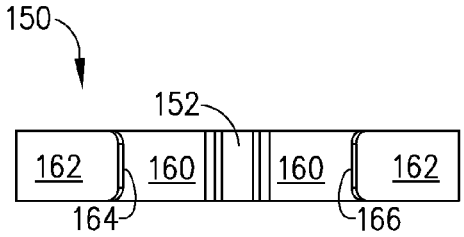

On the other hand, the opposite end of the adapter can be standardized, particularly if the attachment 50 and the adapter 110 are sold by the same supplier. This is the case with a TyRex collated screwdriver tool/adapter, or also similar tools sold by Senco Brands, Inc. In these situations, the small diameter outer surface 112 has a chamfer 130 that extends to the left-most portion of the adapter as seen in FIG. 4C. The chamfer at 130 and the chamfer at 126 have important purposes, and will be discussed in greater detail below.

The interior portions of the adapter 110 can also be discerned in FIG. 4, in which there is an inner diameter surface 132, and a pair of longitudinal ribs at 134 and 136. The ribs 134 and 136 are locating structures, and will keep the adapter 110 from rotating with respect to the attachment 50.

The adapter's exterior surfaces at 112, 116, 118, and 122 act as an exterior mating surface, which mechanically interacts with like three-dimensional surfaces of the attachment. As noted above, the "end" of the adapter 110 that faces the attachment 50 can be standardized to mate with predetermined attachments, particularly of the attachments and the adapter are all supplied by the same vendor. In this manner, the exterior mating surface of the adapter will properly "fit" into like interior mating surfaces of the attachment, as discussed below in greater detail.

FIG. 5 includes four different views, designated as FIG. 5A, FIG. 5B, FIG. 5C, and FIG. 5D. FIG. 5 shows an arcuate-shaped detent spring which is generally designated by the reference numeral 150. Detent spring 150 is generally formed as a leaf spring, and is designed to generally fit around an outer diameter cylindrical surface, which in this attachment interface combination includes such a surface that is part of the rear-most portion of the attachment 50. This arrangement can be better viewed on FIG. 10, in which the detent spring 150 is mostly surrounding a portion 48 of the attachment. In this embodiment, the layer 48 has an outer surface that somewhat widens the diameter of the detent spring 150, after detent spring 150 has been placed over the surface 48. The arcuate shape of detent spring 150 tends to wrap around a portion of the cylindrical outer surface 48 of the attachment (proximal to the open end of portion 40), which will be described in greater detail below.

Detent spring 150 comprises a relatively thin layer of material, typically a metallic material, for durability. A preferred material for detent spring 150 is hardened and tempered spring steel. As can be seen on FIG. 5B, there is an inner surface 160 and an outer surface 162, and these surfaces are mainly annular, and form a majority of a circle. The detent spring does not form a complete circle, but stops at two end portions 164 and 166.

Detent spring 150 also includes a notched portion at 154, which has an inward-facing protruding surface at 152. From the opposite side of the detent spring, the notch 154 can be readily seen in FIGS. 5A and 5B as forming that inner-pointing protrusion that creates the surface 152. The corners of the notch are at 156, as best seen on FIG. 5B.

The inner protrusion surface at 152 will preferably have a relatively smooth curvature, similar to that seen in FIG. 5. This smooth (curved) inner surface will allow the protrusion 152 to slide along the sliding surfaces 122 of the adapter 110, when desired by a user. The protrusion 152 of the detent spring is designed to generally fit within the grooves 124 of the adapter, and once located in one of those grooves 124, the detent spring 150 will remain at that angular orientation when the tool combination is in use. In other words, once the protrusion 152 has moved substantially into contact with one of the grooves 124, then the attachment is said to be in a detent position, and it will not readily move in a radial direction with respect to said adapter.

However, if the user desires to change the angular orientation of the attachment 50 with respect to the power screwdriver 20, this can easily be accomplished by grasping the gripable surface 60 of the attachment and merely twisting it in either the clockwise or counter-clockwise direction. When that occurs, the smooth protrusion surface 152 of the detent spring will be forced out of the current groove 124 in which it resides, and will slide along the sliding surface 122 until reaching the next groove 124, at which time the protrusion 152 will then sit into that "next groove." This all occurs while the attachment 50 remains mounted to the adapter 110 (and thus, remains mounted to the power screwdriver 20).

Of course, if the user wishes to make a larger angular displacement, then the user can continue to twist the attachment, while grasping the gripable surface 60, until reaching the desired angular orientation between the attachment 50 and the power screwdriver 20. The detented aspect of this combination, provided by the multiple grooves 124, gives a definite "feel" to the user of having reached a proper operating position.

The feature described in the previous paragraph provides a substantial benefit to users of collated fastener driver tools, because the available prior tools required the attachment to be completely disconnected from the power screwdriver, and then re-mounted to the power screwdriver at a different angular orientation. This required the operator/user to stop operating the tool, dismount the attachment (using both hands to do so), re-mount the attachment at a different angular orientation (using both hands to do so), and then move his or her hands back to their normal places of operation, i.e., at the handle with the trigger and at the gripable portion of the attachment.

In the case of the structure defined herein, the user never has to remove his or her "first hand" from the trigger handle combination of the power screwdriver 20, and also does not need to remove his or her other ("second") hand from the gripable portion 60 of the attachment. Instead, the attachment can merely be twisted, and the detent spring 150 exhibits sufficient flexibility to allow its inward protruding surface 152 to slide out of one of the grooves 124 in the adapter, and then along the segmented sliding surfaces 122 until reaching an appropriate notch 124 when the user has moved the angular orientation to a new desirable position. The user already has his/her hands in the appropriate operating positions, and can immediately begin driving fasteners into the working surface, within moments after re-orienting the tool's angular position. This is a major advantage that has been lacking in prior tools.

Because the detent spring 150 is somewhat flexible, it can act as a deflectable element. When its inward-facing protruding surface 152 is making contact with one of the sliding surfaces 122 of the adapter 110, the surface 152 will be at a first diametral position with respect to the centerline of the adapter. When its inward-facing protruding surface 152 is making contact with one of the grooves 124 of the adapter 110, the surface 152 will be at a second diametral position that is shorter than the first diametral position described just above. The capacity to deflect and either increase or decrease the effective diametral distance from the centerline allows the detent spring 150 to both move in a radial direction (and allow the radial angular orientation between the attachment 50 and the power screwdriver 20 to be altered), and to provide a detent action (or "feel") to the combination tool 10 as the user is twisting the attachment in this radial movement with respect to the power screwdriver. The same is true for the leaf spring embodiment described below, in connection with FIG. 12.

Referring now to FIG. 6, there are five separate views, designated as FIG. 6A, FIG. 6B, FIG. 6C, FIG. 6D, and FIG. 6E. These five views all show a retaining latch, generally designated by the reference numeral 170. More specifically, this is the right-hand latch, as would be viewed by a user of the screwdriver tool/attachment combination depicted in FIG. 1. A similar latch 171 is located on the left-hand side of the tool combination, and has certain angular surfaces that are a mirror image of the latch 170 that is depicted in FIG. 6. Latches 170 and 171 are movable, and are designed to be manually actuated, as described below.

Figure 6A:
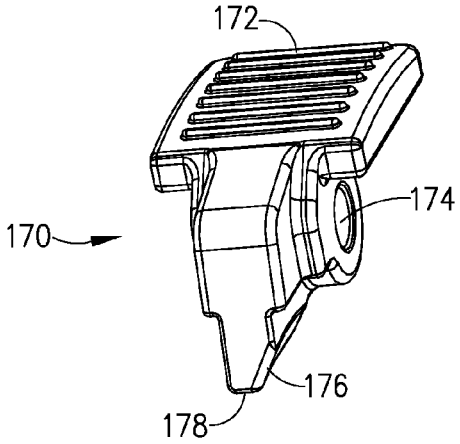
FIG. 6 has five views, FIGS. 6A, 6B, 6C, 6D, and 6E, showing a pivotable latch used in the combination tool of FIG. 1, showing a perspective view, top view, side longitudinal view, left-hand side view, and right-hand side view, respectively.
Figure 6D:
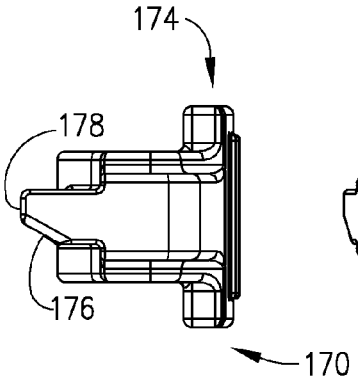
Figure 6B:
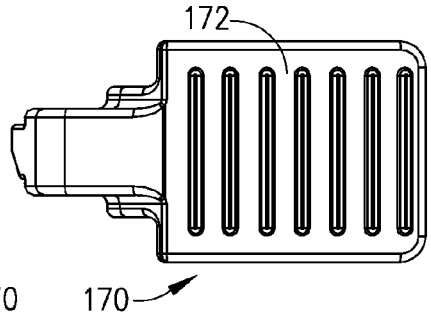
Figure 6E:
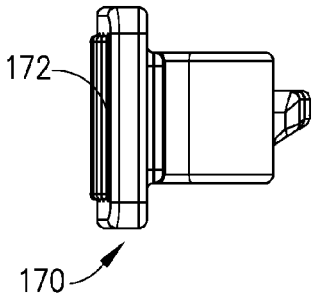
Figure 6C:
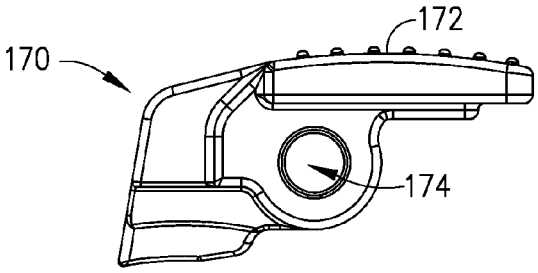

Referring to FIG. 6A, there is a finger pad surface 172, an opening 174 for a retainer pin (not shown) that allows the latch to pivot, a latch surface 178, and a sliding surface that is chamfered at 176. The latch surface 178 acts as a contact member, and fits into the groove 114 that is seen in the bottom view, FIG. 3. It will be understood that this annular groove 114 runs all the way around the outer cylindrical surface of that portion of the adapter 110. This keeps the attachment 50 in place (i.e., in a fixed axial relationship with the adapter), after being mounted onto the adapter 110.

If one wishes to dismount the attachment from the power screwdriver, then the latches 170 and 171 can easily be manually actuated by pressing in on the finger pad 172 (and a similar finger pad on the latch 171), and this will force the latching surface 178 away from the groove 114. This action effectively disengages the contact member (latching surface) 178 from the area of the exterior mating surface of the adapter, which then allows the attachment 50 to be removed from the adapter 110. Latches 170 and 171 are spring-loaded, and thereby mechanically biased to force the latching surface 178 toward the center of the attachment 50.

The chamfered surface 176 allows the attachment and the adapter 110 to be slid together without manually actuating the latches 170 or 171. When mounting the attachment to the front end of the adapter, the surface 176 will slide along the chamfered end surface 130 of the adapter, as best seen in FIG. 4C. When this action occurs, the two latches 170 and 171 are both somewhat actuated and pivoted out of the way so that they ride up over the outer diameter surface at 112 of the adapter. When they reach the groove 114, the spring-loaded latches 170 and 171 will be forced into that groove, and will stay in that position, in a mounted relationship between the adapter 110 and the attachment 50.

The chamfered surfaces 126 on the adapter 110 also allow the adapter to be slid into the interior region of the attachment at any angle. In the prior art attachment devices, there are ribbed surfaces that must match up to interior slots, and those structures only allow the attachment to be mounted onto the power screwdriver at certain angles.

Figure 7:
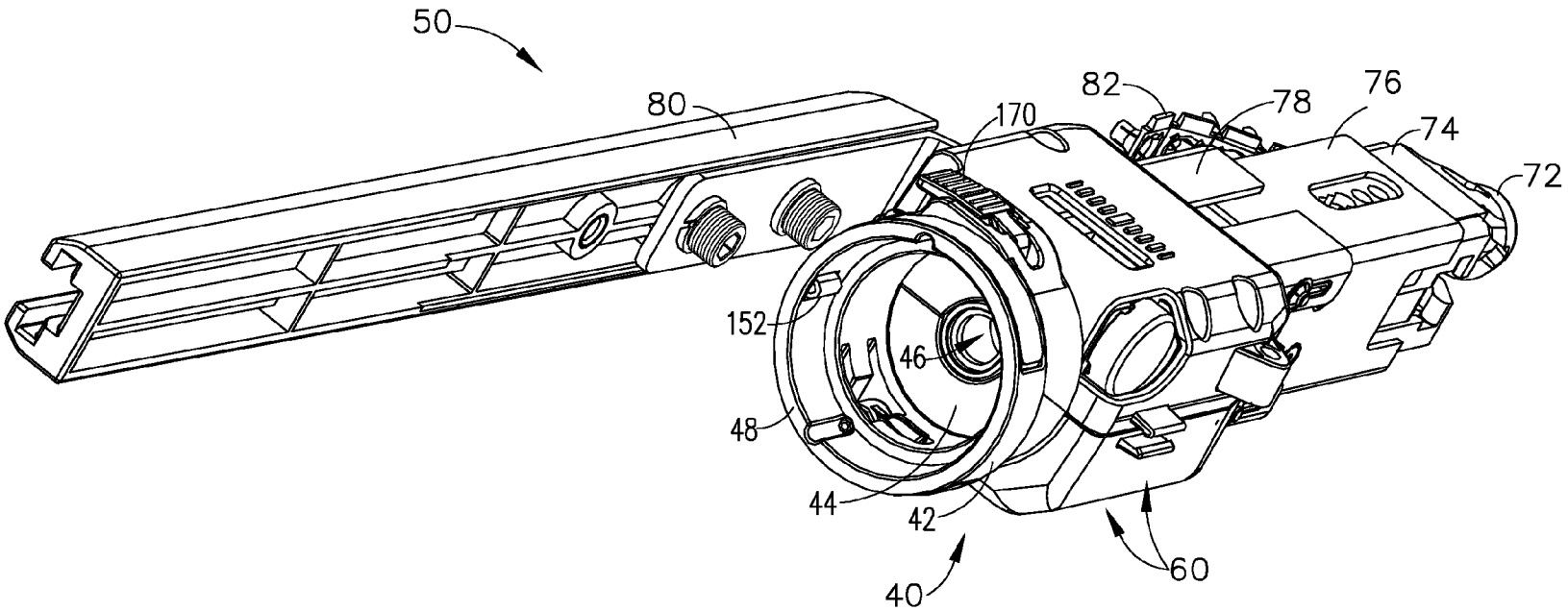
FIG. 7 is a perspective view of the attachment used in the combination tool of FIG. 1, from the rear, below, and the right-hand side.

Referring now to FIG. 7, the attachment 50 intended for use with the adapter 110 is depicted in a perspective view that shows some of the interior regions within which the adapter 110 is to be placed. In this view, the right-hand latch 170 can be seen, along the rear-portion of the exterior surface of the attachment. This rear portion is designated by the reference numeral 40, and the rear-most exterior cylindrical surface is at 42.

The rear portion 40 has an interior mating surface, which includes a planar circular surface 44 that serves as a mechanical stop for the left-most surface at 130 of the adapter (as seen in FIG. 4C). In the middle of that planar surface 44 is an opening 46, through which the drive bit of the attachment is to be placed, which drives the lead fastener that is in the "driving position" as the screwdriver tool is actuated.

Adjacent to the exterior cylindrical surface 42 is the rear-most facing surface 48, which has a mostly annular shape as can be seen in FIG. 7. This surface 48 will abut against the largest diameter portion of the adapter 110, when the attachment is mounted to the power screwdriver 20. In this manner, the interior mating surface of the rear portion 40 of the attachment will mate to the exterior mating surface of the adapter 110. A preferred material for the mating surface areas of the attachment is a thermoset plastic, such as nylon.

Figure 8:
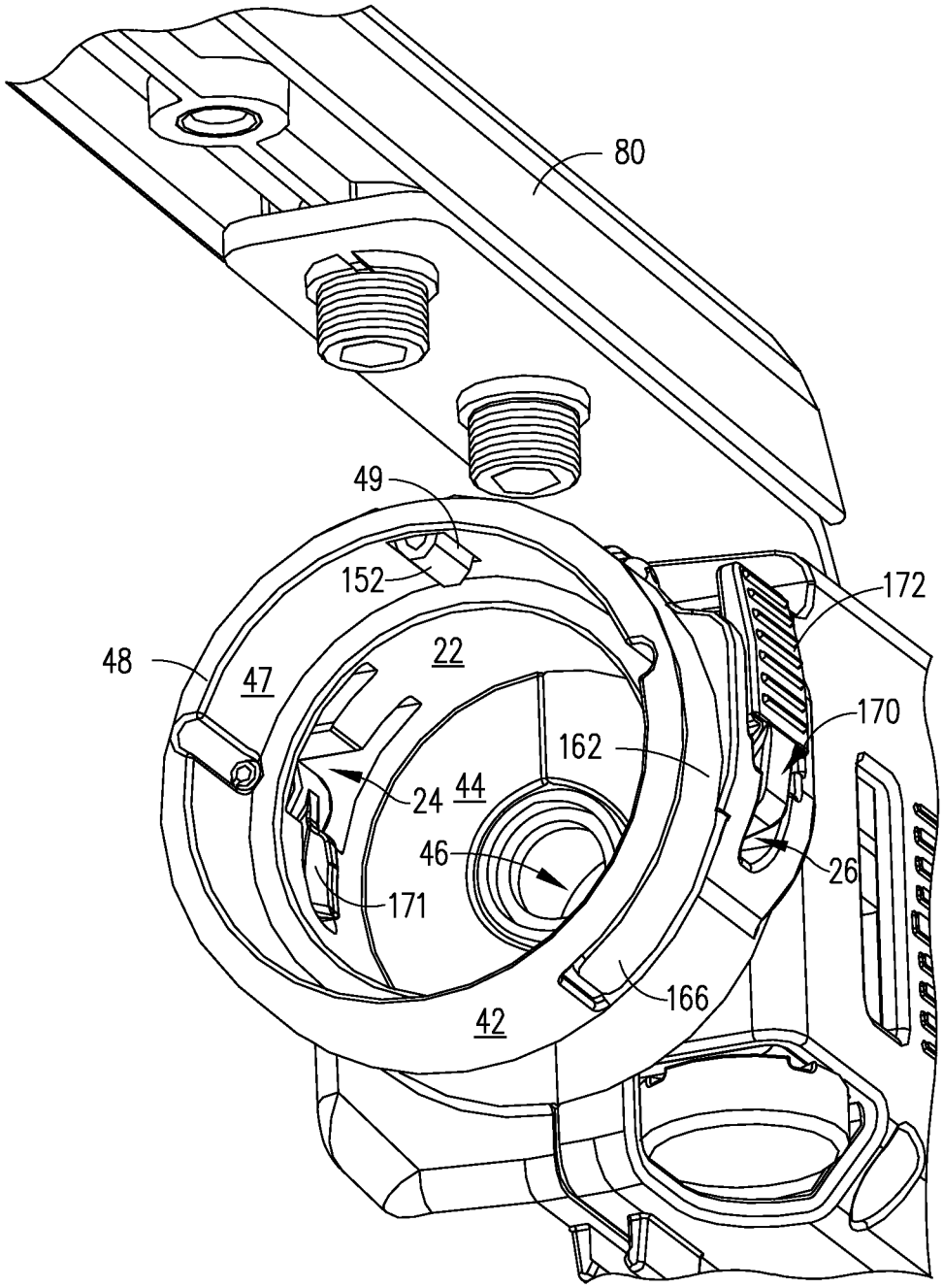
FIG. 8 is a magnified view of a portion of the perspective view of FIG. 7.

Referring now to FIG. 8, a magnified view of a portion of the perspective view of FIG. 7 is illustrated. In this view, portions of both the right-hand latch 170 and the left-hand latch 171 are visible. The outer surface of the rear-most cylindrical portion of the adapter is visible at 42, as is the annular rear-most surface 48. An interior surface of this cylindrical portion is visible at 47. Also visible are the planar surface 44 and the central opening therewithin, at reference numeral 46.

A further interior cylindrical surface is visible at 22, and this surface has shaped opening formed therewithin. One of the openings is at 24, which works with the left-hand latch 171, and a similar shaped opening is at 26, which works with the right-hand latch 170.

Portions of the detent spring 150 are visible on FIG. 8. The right-hand outer surface 162 is visible, as it extends down to its farthest end-point at 166. The interior protrusion 152 of the notched portion of the detent spring is also visible. This protruding portion 152 extends through a slotted opening 49 that is formed in the interior surface 47 of the housing of the attachment. Opening 49 provides a keyed position to hold the detent spring 150 in position, with respect to the rear portion 40 of the attachment housing. When the inner protruding surface 152 is radially rotated, and thereby slides along the sliding surfaces 122 of the adapter 110, the entire attachment 50 radially rotates along with the detent spring. It is this action that allows the user to quickly and easily change the angular orientation of the attachment 50 with respect to the power screwdriver 20 of the entire combination tool 10.

Figure 9:
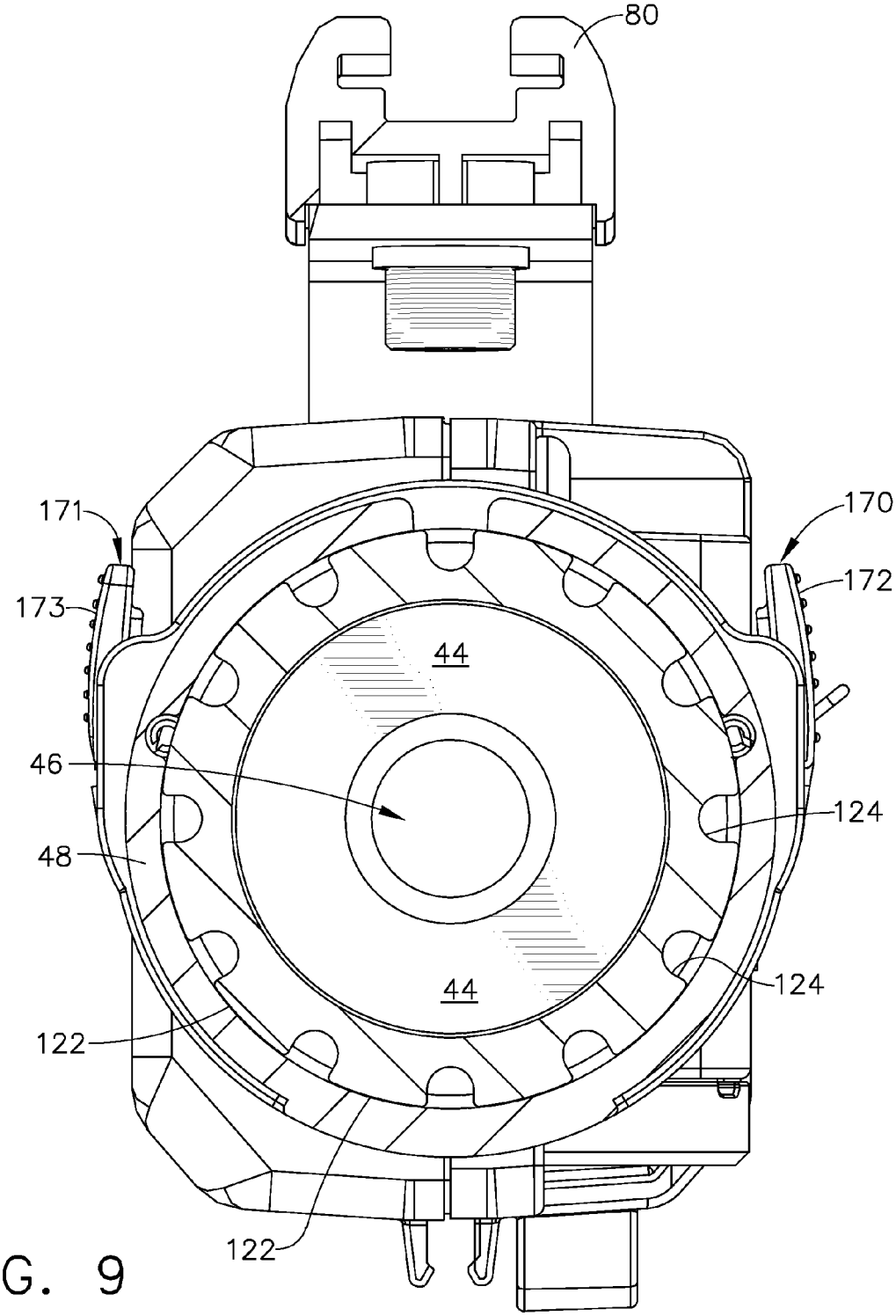
FIG. 9 is a cross-section view taken along the line 9-9 of FIG. 3.

FIG. 9 is a section view of the attachment 50, taken along a section line 9-9 that goes through the sliding surfaces 122 and grooves 124 of the adapter 110—see FIG. 4C and FIG. 3. It should be noted that FIG. 4C is not a "classical" section view, because FIG. 9 includes the attachment 50 and a portion of the adapter 110 in a single view, as in FIG. 3.

In FIG. 9, the two latches 170 and 171 can be seen, and their respective finger pad surfaces 172 and 173 are visible. Portions of the rear area of the attachment are seen, including the annular surface 44 and its opening 46, and annular rear-most surface 48. In addition, certain structural features of the adapter 110 can be seen, including its segmented sliding surfaces 122, and its grooves 124 (which separate the various segmented sliding surfaces 122).

Figure 10:
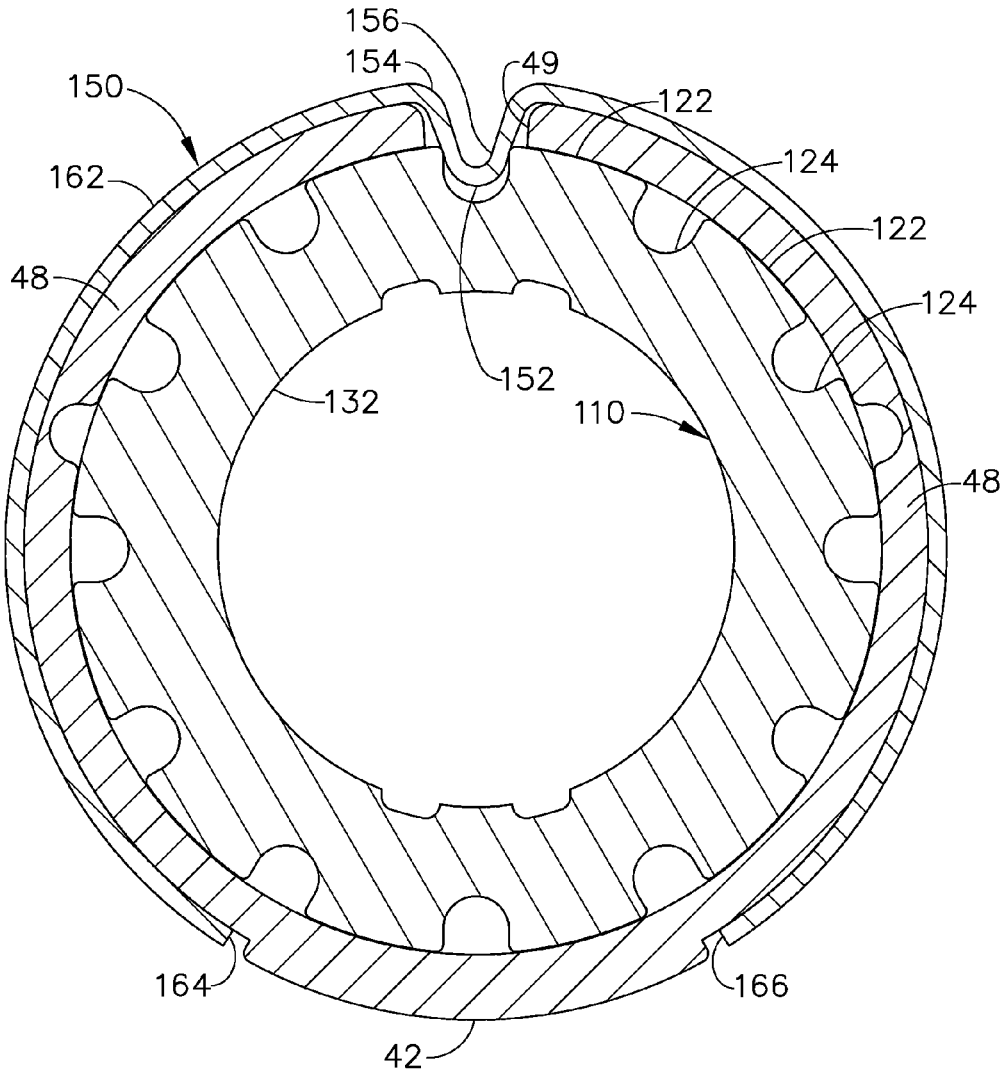
FIG. 10 is a magnified cross-section view of a portion of the structure of FIG. 9, additionally showing the detent spring.

Referring now to FIG. 10, a cross-section view is provided of a combination of the rear-most portion 40 of the attachment, a portion of the adapter 110, and a cross-section view of the detent spring 150. This view shows the orientation of all three of these elements, and how they line up when the protruding interior portion 152 is fitted within one of the grooves 124 of the adapter. As can be seen in FIG. 10, the interior diameter of the adapter is seen at 132, and the annular cross-section thickness of the adapter is seen between that inner diameter 132 and the outer diameter of the sliding surfaces 122.

Also visible on FIG. 10 is the shape of the outer diameter or outer surface of the rear-portion of the attachment housing. The rear-most surface of the attachment housing is depicted at 48, but this structure is not a pure cylinder with a single outer diameter. Instead, it changes outer diameter at a "thicker" portion 42 that can be clearly seen on FIG. 10. This larger diameter portion 42 provides end stops, if needed, for the distal end portions 164 and 166 of the detent spring 150.

The detent spring 150 is somewhat expanded in diameter so that it fits around the outer surface 48 of the housing of the attachment. The inward-facing protrusion 152 rests against the groove 124 of the adapter, while the long extending "leaf-spring" portions of the detent spring at 162 extend down around the outer surface 48 of the attachment housing, to the end portions 164 and 166.

Figure 11:
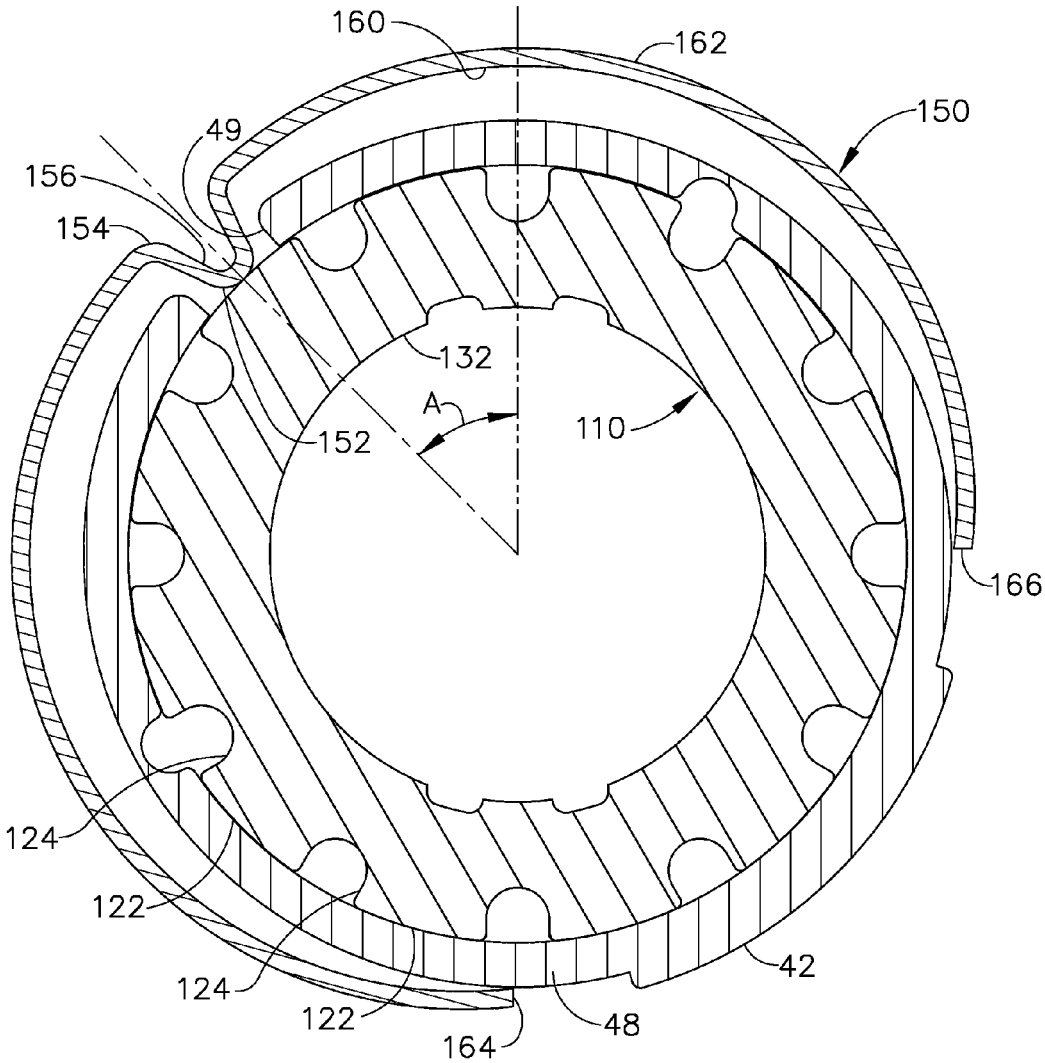
FIG. 11 is a cross-section view of the structure depicted in FIG. 10, in which the detent spring has been pushed out of one of the grooves and is making contact with a sliding surface of the adapter.

Referring now to FIG. 11, this is a similar view to that of FIG. 10, except in FIG. 11, the detent spring is making contact with one of the slidable surfaces 122 of the adapter, and thus its inward-protruding surface 152 is not fitted within one of the grooves 124. In this condition, the inner surfaces of the detent spring at 160 are not in mechanical contact with the outer surface of the rear portion 48 of the attachment; they have been somewhat separated from outer surface 48, and thereby become spaced apart from that outer surface. In this state, only at the distal end points 164 and 166 does the "leaf spring" portion of the detent spring 150 physically touch the housing portion 48 of the attachment. This is so because the protruding portion 152 has been pushed away from the center of the structure, and is resting against one of the sliding surfaces 122 of the adapter. The overall shape of the detent spring 150 is substantially the same as before, but it has been forced farther away from the centerline of the entire structure.

After the user rotates the adapter a predetermined distance with respect to the attachment by use of a twisting motion, the inward-facing protrusion 152 is once again forced by spring action of the leaf spring portion of detent spring 150 into one of the other grooves 124. At that point, the user will feel a mechanical detent action that tends to stop the radial sliding motion of the protrusion of the detent spring, with the adapter and attachment now at a second angular orientation. When that occurs, the overall shape of this combination will once again have an appearance as that depicted in FIG. 10.

To summarize this description of the first embodiment, the geometry of the adapter includes axial slots or grooves around one of its diameters. A detent spring is contained by the housing of the attachment, and includes a "V" shaped notch which extends through an opening in the perimeter of the housing of the attachment. This notch engages into one of the grooves of the adapter, and it can be said that the attachment and adapter are at a first radial angular position at this operating state.

If the operator twists the attachment, the notch of the detent spring becomes raised out of the slot/groove, and re-engages in the next slot along the angular travel of the outer surface of the adapter, and it can be said that the attachment and adapter are now at a second radial angular position at this operating state. This "next slot" (or groove) creates a detent position; a detent position is created at each of these slots/grooves in the adapter. These detent positions provide a "feel" to the operator that a correct operating position has been reached. The adapter is not able to rotate with respect to the screwdriver, as it is rigidly attached to the screwdriver. By moving the attachment with respect to the adapter, the human user has changed the radial angle orientation between the attachment 50 and the power screwdriver 20, along the angle "A" as seen on FIG. 11.

The detent spring is open on its bottom, which allows the V-shaped notch to rise out, away from the slots/grooves in the adapter, and then snap back into the next slot because of the spring action of the detent spring. This open space at the detent spring bottom becomes alternately smaller and larger as the detent spring ratchets around the adapter.

The pair of latches have chamfered surfaces that are spring-loaded inward, and allow the operator simply pull the attachment onto the adapter, without touching the latches 170 and 171. The two latches swing out via two tapered surfaces (i.e., on the latch and on the front of the adapter), until the latches reach a radial groove 114 in the adapter. Then the latches drop into position and prevent axial movement of the attachment with respect to the adapter. The latches have extensions that fit into the groove that prevent accidental removal of the attachment from the adapter. Since the groove travels entirely around the outer cylindrical surface of the adapter, the attachment can be moved to any angular position desired while still remaining attached to the adapter.

Figure 12:
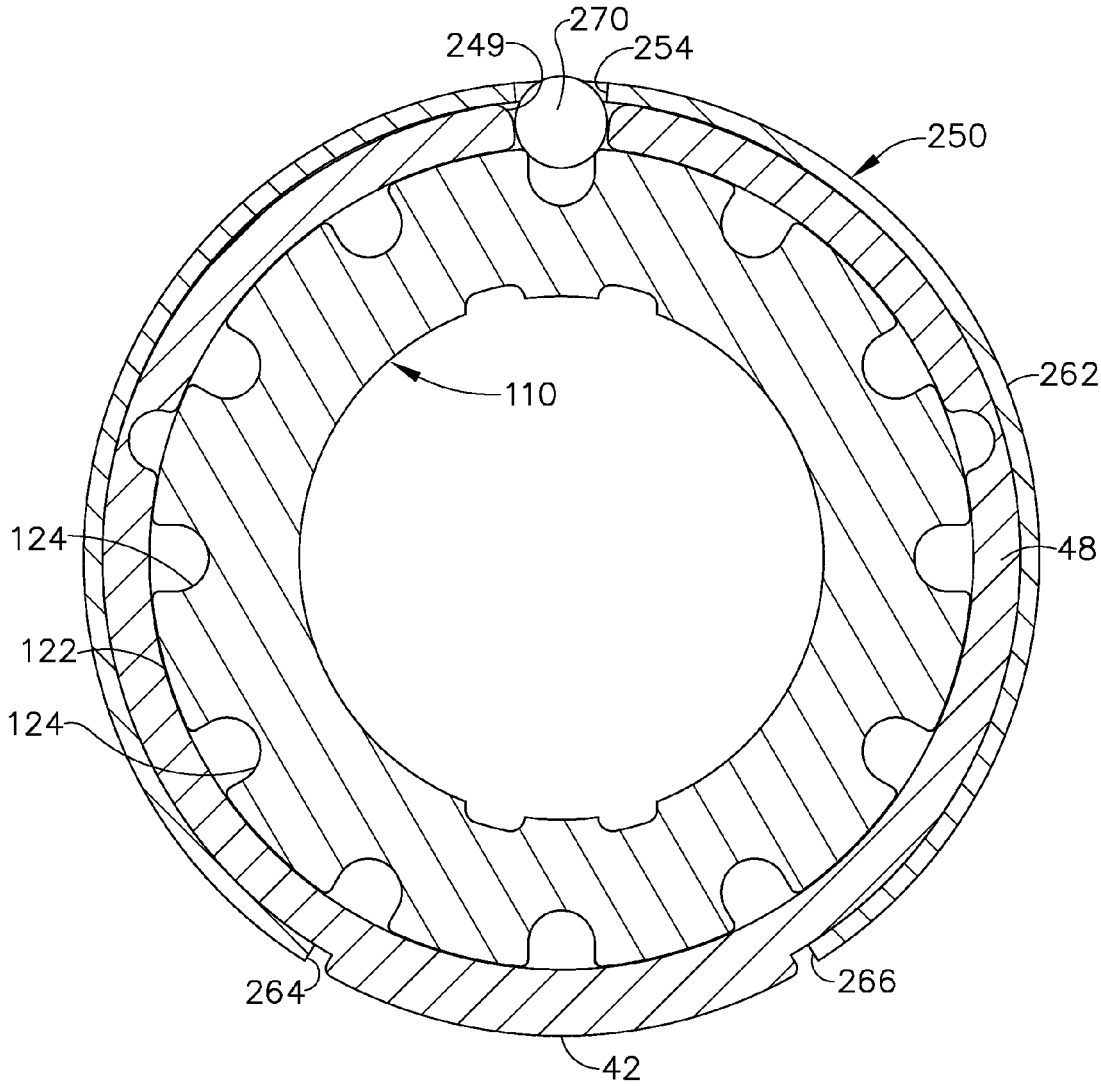
FIG. 12 is a cross-section view of an alternative embodiment of the adapter and a rear portion of the housing, showing a leaf spring, in which the spring has no notch, but instead a spherical element is used to fit within one of the grooves, or to be pushed outside the groove and slide along one of the sliding surfaces of the adapter of the combination tool of FIG. 1.

A second, alternative embodiment is illustrated in FIG. 12. Instead of a detent spring 150 that has an inward-facing protrusion, the detent spring is shaped more like a classical leaf spring. This leaf spring structure is generally designated by the reference numeral 250. There is an opening 254 in this leaf spring 250 so that a spherical element 270 can be placed between the leaf spring 250 and the adapter 110. This spherical element 270 can be a fairly simple structure, such as a ball bearing. Leaf spring 250 comprises a relatively thin layer of material, typically a metallic material, for durability. A preferred material for leaf spring 250 is hardened and tempered spring steel.

In this embodiment, the spherical element 270, when resting in one of the grooves 124, allows most of the leaf spring 250 to substantially contact the outer surface of the portion 48 of the rear housing of the attachment. The rear housing of the attachment has the same overall shape at 48, and at its larger diameter portion 42, as those structures that are illustrated on FIG. 10. The ends of the leaf spring 250 are depicted at 264 and 266, and the interior surface of the leaf spring 250 will generally rest against the outer cylindrical surface of the element 48 of the attachment. As in the first embodiment, the arcuate shape of detent spring 250 tends to wrap around a portion of the cylindrical outer surface 48 of the attachment (proximal to the open end of portion 40), and the distal ends 264 and 266 nearly reach the larger diameter portion of the outer surface at 42.

When the user desires to change angular orientations between the attachment and the adapter, then the leaf spring 250 will have sufficient "give" to allow the spherical element 270 to be forced out of the groove 124 and farther away from the centerline of the overall structure. In essence, the combination of the spherical element 270 and the leaf spring 250 acts as a deflectable element. When that occurs, the spherical element 270 will rest against one of the sliding surfaces 122 and this will force the leaf spring 250 to be pushed away from the cylindrical outer surface 48 of the rear portion of the attachment housing; most of the leaf spring surface will be spaced apart from the outer surface 48, except for the distal ends 264 and 266. In that situation, the leaf spring 250 will have much the same shape as that depicted on FIG. 11 for the detent spring 150. Of course, there will be no inward protruding portion 152 in this embodiment depicted on FIG. 12. Instead, the ball bearing-shaped spherical element 270 will provide a sliding (or perhaps rolling) surface and the separation mechanical advantage that pushes most of the leaf spring 250 away from the outer cylindrical surface 48. This is just one of several potential alternative structures that could be used for providing a twistable structure that can be used to change the angular orientation between the attachment housing and the adapter 110 (which is fixedly attached to the power screwdriver).

After the user rotates the adapter a predetermined distance with respect to the attachment by use of a twisting motion, the spherical element 270 is once again forced by spring action of the leaf spring structure of detent spring 150 into one of the other grooves 124. At that point, the user will feel a mechanical detent action that tends to stop the radial sliding (or rolling) motion of the spherical element, with the adapter and attachment now at a second angular orientation. When that occurs, the overall shape of this combination will once again have an appearance as that depicted in FIG. 12. In essence, the deflectable element (either the detent spring 150 or the leaf spring 250 with spherical element) is able to move in a diametral direction, but at the same time it is retained by the attachment.

Similar to the structure that is illustrated in FIG. 8, in the second embodiment the spherical element 270 protrudes through an opening 249 (e.g., a tapered hole) that is formed in the interior surface of the housing of the attachment, and also protrudes through the opening 254 in the leaf spring. Opening 249 provides a keyed position to hold the detent spring 250 in position, with respect to the rear portion 40 of the attachment housing. The spherical element 270 is held in a predetermined angular position by the opening 254 of leaf spring 250. When the spherical element 270 is radially rotated with respect to adapter 110, and thereby slides (or rolls) along the sliding surfaces 122 of the adapter 110, the entire attachment 50 radially rotates along with the leaf spring 250. It is this action that allows the user to quickly and easily change the angular orientation of the attachment 50 with respect to the power screwdriver 20 of the entire combination tool 10.

It should be noted that the curvature of the spherical element 270 (of the second embodiment) and the curvature of the protrusion 152 of the detent spring (of the first embodiment) should not be so gradual that these elements very easily "pop out" of the grooves 124 of the adapter 110. Otherwise, the angular orientation of the attachment 50 compared to the power screwdriver 20 might suddenly change during a fastener driving operation of the overall tool combination 10, and that event typically would be unwelcome.

If desired, an adapter/attachment interface could be designed to allow very gradual angular orientation changes, and such an embodiment could have a different fixing or semi-locking mechanism to hold the angular orientation in place during operation of the tool; the user would then be able to select yet additional angular "settings" and then change the orientation by a twisting action. This additional alternative embodiment is contemplated by the inventors. It should be noted, however, that the twelve-position adapter 110 that is illustrated in FIGS. 4, 10, and 12, has significant advantages, and although additional grooves 124 might seem to be advantageous, there probably is little to be gained in actual operation to having further angular offsets as compared to the 30-degree offsets that are illustrated herein.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

All documents cited in the Background and in the Detailed Description are, in relevant part, incorporated herein by reference; the citation of any document is not to be construed as an admission that it is prior art with respect to the technology disclosed herein. The following patent documents are assigned to Senco Brands, Inc., and are incorporated herein by reference in their entirety: U.S. Pat. No. 5,988,026, titled SCREW FEED AND DRIVER FOR A SCREW DRIVING TOOL; U.S. Pat. No. 7,032,482, titled TENSIONING DEVICE APPARATUS FOR A BOTTOM FEED SCREW DRIVING TOOL FOR USE WITH COLLATED SCREWS; U.S. Pat. No. 7,082,857, titled SLIDING RAIL CONTAINMENT DEVICE FOR FLEXIBLE COLLATED SCREWS USED WITH A TOP FEED SCREW DRIVING TOOL; and U.S. Pat. No. 7,493,839, titled PORTABLE SCREW DRIVING TOOL WITH COLLAPSIBLE FRONT END.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A tool apparatus, comprising:

(a) an attachment having: (i) a first end with an indexing mechanism to move a collated strip of fasteners so that the fasteners can be driven, and (ii) a second end with an open area having an interior mating surface;

(b) an adapter having a third end with an exterior mating surface, and a fourth end that is shaped for mounting to a power screwdriver;

(c) said exterior mating surface of the adapter is shaped to fit within said interior mating surface of the attachment;

(d) said attachment includes at least one manually-actuated movable latch that, if not actuated, has a contact member that engages an area of said exterior mating surface of the adaptor to hold said attachment and said adapter in a substantially fixed axial relationship, wherein if the movable latch is actuated, said contact member becomes disengaged from said area of the exterior mating surface of the adapter, and thereby allows said attachment to be dismounted from said adapter;

(e) said exterior mating surface including an area that comprises a plurality of sliding surfaces that are separated from one another by a plurality of grooves formed in said area; and (f) said interior mating surface including a detent spring that exhibits an inward-facing protrusion that, when said adapter is mated to said attachment, is in physical contact with at least one of: (i) said plurality of sliding surfaces and (ii) said plurality of grooves, such that:

if said protrusion is substantially in contact with one of the plurality of grooves, then said attachment is in a detent position and will not readily move in a radial direction with respect to said adapter; and if said protrusion is substantially in contact with one of the plurality of sliding surfaces, then said attachment is in a condition that allows movement in said radial direction with respect to said adapter, while said attachment remains mounted to said adapter.

2. The tool apparatus of claim 1, wherein: said detent spring has an arcuate shape that tends to wrap around a portion of a cylindrical outer surface of said attachment proximal to said second end; said cylindrical outer surface of the attachment exhibits an opening; and said inward-facing protrusion of the detent spring extends through said opening in the cylindrical outer surface of the attachment.

3. The tool apparatus of claim 2, wherein:

(a) if said protrusion of the detent spring is in contact with one of the plurality of grooves of the adapter, then said arcuate shape of the detent spring is substantially in physical contact with said portion of the cylindrical outer surface of the attachment, and (b) if said protrusion of the detent spring is in contact with one of the plurality of sliding surfaces of the adapter, then a portion of said arcuate shape of the detent spring is spaced apart from said portion of the cylindrical outer surface of the attachment, although distal ends of said detent spring still make physical contact with said portion of the cylindrical outer surface of the attachment.

4. The tool apparatus of claim 2, wherein:

(a) when said protrusion of the detent spring is in contact with one of the plurality of grooves of the adapter, a human user of the tool apparatus can grasp an outer surface of the attachment and apply a twisting motion, while holding the adapter in place; and (b) a shape of said protrusion of the detent spring is curved such that it slides in a radial direction out of the groove, and then comes into contact with one of the plurality of sliding surfaces of the adapter where it continues to slide in said radial direction until it reaches a second one of the plurality of grooves of the adapter, and then it is forced, by spring action of said detent spring, into said second one of the plurality of grooves of the adapter, and said human user will feel a mechanical detent that tends to stop the radial sliding motion of the protrusion of the detent spring, with said adapter and attachment at a second angular orientation.

5. The tool apparatus of claim 4, wherein: the human user can continue to apply a twisting motion so that said protrusion of the detent spring continues to slide in said radial direction past said second one of the plurality of grooves of the adapter, until reaching a third one of the plurality of grooves of the adapter, and it is forced, by spring action of said detent spring, into said third one of the plurality of grooves of the adapter, and said human user will feel a mechanical detent that tends to stop the radial sliding motion of the protrusion of the detent spring, with said adapter and attachment at a third angular orientation.

6. The tool apparatus of claim 1, wherein: said exterior mating surface of the adaptor comprises an annular groove in said adapter that runs completely around a cylindrical outer surface of said adapter, thereby allowing said contact member of the movable latch to remain in contact with said annular groove at any radial angular orientation between said attachment and said adapter, without having to dismount said attachment from said adapter.

7. The tool apparatus of claim 1, wherein: said contact member of the movable latch exhibits a first chamfered actuator surface, and said adapter exhibits a second chamfered end surface, such that first chamfered actuator surface slides along the second chamfered end surface and allows said attachment and adapter to be slid together without manually actuating said at least one latch.

8. The tool apparatus of claim 1, wherein: said adapter exhibits a chamfered surface that is proximal to said plurality of sliding surfaces of the exterior mating surface, and thereby allows said third end of the adapter to be slid into said second end of the attachment at any radial angle of orientation between said adapter and said attachment.

9. A tool apparatus, comprising:

(a) an attachment having: (i) a first end with an indexing mechanism to move a collated strip of fasteners so that the fasteners can be driven, and (ii) a second end with an open area having an interior mating surface;

(b) an adapter having a third end with an exterior mating surface, and a fourth end that is shaped for mounting to a power screwdriver;

(c) said exterior mating surface of the adapter is shaped to fit within said interior mating surface of the attachment;

(d) said attachment includes at least one manually-actuated movable latch that, if not actuated, has a contact member that engages an area of said exterior mating surface of the adaptor to hold said attachment and said adapter in a substantially fixed axial relationship, wherein if the movable latch is actuated, said contact member becomes disengaged from said area of the exterior mating surface of the adapter, and thereby allows said attachment to be dismounted from said adapter;

(e) said exterior mating surface including an area that comprises a plurality of sliding surfaces that are separated from one another by a plurality of grooves formed in said area; and (f) said interior mating surface including a spherical member that is held in a predetermined angular position by an opening of a leaf spring, and when said adapter is mated to said attachment, said spherical member is in physical contact with at least one of: (i) said plurality of sliding surfaces and (ii) said plurality of grooves, such that:

if said spherical member is substantially in contact with one of the plurality of grooves, then said attachment is in a detent position and will not readily move in a radial direction with respect to said adapter; and if said spherical member is substantially in contact with one of the plurality of sliding surfaces, then said attachment is in a condition that allows movement in said radial direction with respect to said adapter, while said attachment remains mounted to said adapter.

10. The tool apparatus of claim 9, wherein: said leaf spring has an arcuate shape that tends to wrap around a portion of a cylindrical outer surface of said attachment proximal to said second end; said cylindrical outer surface of the attachment exhibits an opening; and said spherical member extends through said opening in the cylindrical outer surface of the attachment.

11. The tool apparatus of claim 10, wherein:

(a) if said spherical member is in contact with one of the plurality of grooves of the adapter, then said arcuate shape of the leaf spring is substantially in physical contact with said portion of the cylindrical outer surface of the attachment, and (b) if said spherical member is in contact with one of the plurality of sliding surfaces of the adapter, then a portion of said arcuate shape of the leaf spring is spaced apart from said portion of the cylindrical outer surface of the attachment, although distal ends of said leaf spring still make physical contact with said portion of the cylindrical outer surface of the attachment.

12. The tool apparatus of claim 10, wherein:

(a) when said spherical member is in contact with one of the plurality of grooves of the adapter, a human user of the tool apparatus can grasp an outer surface of the attachment and apply a twisting motion, while holding the adapter in place; and (b) a shape of said spherical member is curved such that it slides in a radial direction out of the groove, and then comes into contact with one of the plurality of sliding surfaces of the adapter where it continues to slide in said radial direction until it reaches a second one of the plurality of grooves of the adapter, and then it is forced, by spring action of said leaf spring, into said second one of the plurality of grooves of the adapter, and said human user will feel a mechanical detent that tends to stop the radial sliding motion of the spherical member, with said adapter and attachment at a second angular orientation.

13. The tool apparatus of claim 12, wherein: the human user can continue to apply a twisting motion so that said spherical member continues to slide in said radial direction past said second one of the plurality of grooves of the adapter, until reaching a third one of the plurality of grooves of the adapter, and it is forced, by spring action of said leaf spring, into said third one of the plurality of grooves of the adapter, and said human user will feel a mechanical detent that tends to stop the radial sliding motion of the spherical member, with said adapter and attachment at a third angular orientation.

14. The tool apparatus of claim 9, wherein: said exterior mating surface of the adaptor comprises an annular groove in said adapter that runs completely around a cylindrical outer surface of said adapter, thereby allowing said contact member of the movable latch to remain in contact with said annular groove at any radial angular orientation between said attachment and said adapter, without having to dismount said attachment from said adapter.

15. The tool apparatus of claim 9, wherein: said contact member of the movable latch exhibits a first chamfered actuator surface, and said adapter exhibits a second chamfered end surface, such that first chamfered actuator surface slides along the second chamfered end surface and allows said attachment and adapter to be slid together without manually actuating said at least one latch.

16. The tool apparatus of claim 9, wherein: said adapter exhibits a chamfered surface that is proximal to said plurality of sliding surfaces of the exterior mating surface, and thereby allows said third end of the adapter to be slid into said second end of the attachment at any radial angle of orientation between said adapter and said attachment.

* * * * *